United States Patent [19]

Nevgod et al.

[11] Patent Number: 4,669,658

[45] Date of Patent: Jun. 2, 1987

[54] GAS DETONATION COATING APPARATUS

[75] Inventors: Vasily A. Nevgod; Valery K. Kadyrov; Albert M. Khairutdinov, all of Kiev, U.S.S.R.

[73] Assignee: Institut Problem Materialovedenia An USSR, Kiev, U.S.S.R.

[21] Appl. No.: 803,203

[22] Filed: Nov. 27, 1985

[51] Int. Cl.[4] ..... B05B 1/24; B05B 7/12; F23D 11/10

[52] U.S. Cl. ..... 239/81; 239/135; 239/139; 239/416.5; 239/423

[58] Field of Search ..... 239/79, 80, 81, 85, 239/86, 416.5, 423, 135, 139, 590.5

[56] References Cited

U.S. PATENT DOCUMENTS

| | | | |
|---|---|---|---|
| 3,344,992 | 10/1967 | Norris | 239/79 |
| 3,627,965 | 12/1971 | Zweig | 239/80 |
| 3,677,471 | 7/1972 | Deakin | 239/81 |
| 4,004,735 | 1/1977 | Zverev | 239/79 |
| 4,065,057 | 12/1977 | Durmann | 239/135 |
| 4,386,737 | 6/1983 | Antonov et al. | 239/79 |

*Primary Examiner*—Andres Kashnikow
*Assistant Examiner*—Patrick N. Burkhart
*Attorney, Agent, or Firm*—Burgess, Ryan & Wayne

[57] ABSTRACT

A gas detonation coating apparatus comprises a barrel enclosed in a casing, a spark plug associated with the barrel through a main pipe, a gas heating means associated with the barrel, a gas heating control means installed on an end of the barrel, and a powder sprayer incorporated in the barrel. Associated with the barrel through additional pipes is a buffer unit provided with gas conduits connected with a gas supply means.

12 Claims, 5 Drawing Figures

GAS DETONATION COATING APPARATUS

TECHNICAL FIELD

The invention relates to industrial use of the gas detonation process, and more particularly, to gas detonation coating apparatus.

The present invention may be used for applying metal, cermet, ceramic, wear-resistant, heat-resistant and other coatings to parts of various-purpose machines and apparatus.

BACKGROUND OF THE INVENTION

Industrial application of detonation processes may involve the use of explosive mixtures of various gases. When used as a combustible gas, acetylene is very dangerous to handle due to high detonability of acetylene-oxygen mixtures. Moreover, acetylene can detonate even with oxygen fully absent. It is noteworthy, too, that acetylene is more costly than such combustible gases as, for instance, natural gas or fuel gas (a mixture of propane and butane).

Use of hardly detonatable cheap combustible gases of the propane-butane type is preferable from the viewpoint of explosion hazard and economy. However, apparatus using such combustible gases feature an elongated pre-detonation portion (that of transition from slow combustion to detonation), reaching several diameters of the barrel bore, which exceeds ten- or even hundred-fold the length of the pre-detonation portion in apparatus using acetylene-oxygen mixtures. Therefore, replacing acetylene by hardly detonatable combustibles without introducing special devices to accelerate the burning-to-detonation transitional process and, consequently, without reducing the pre-detonation length, is conducive to larger dimensions of apparatus, lower capacity thereof, and higher consumption of working gases.

Known in the art is a gas detonation coating apparatus/cf. U.S. Pat. No. 3,150,828, class 239–79, 1964) comprising a barrel enclosed in a casing, a spark plug associated with the barrel through a main pipe, a powder sprayer inserted in the barrel, a buffer unit provided with gas conduits and associated with the barrel through additional pipes, and a gas supply system connected with the gas conduits of the buffer unit.

However, the amount of propane-butane and oxygen mixture being fed in the given case depends on the length of the pre-detonation portion, which results in excessive gas consumption.

Furthermore, higher gas consumption and the presence of the slow burning-to-detonation portion in the given apparatus extends the time required for one operating cycle and, consequently, reduces the detonation rate, i.e. the capacity of the apparatus.

Also, the elongated portion, transitional from slow burning to detonation, necessitates a longer barrel.

BRIEF DESCRIPTION OF THE INVENTION

An object of the present invention is to provide a gas detonation coating apparatus, which would allow gases to be economized.

Another object of the present invention is to increase the capacity of the gas detonation coating apparatus.

This is accomplished by providing a gas detonation coating apparatus comprising a barrel enclosed in a casing, a spark plug associated with the barrel through additional pipes, a gas supply system connected with gas conduits of a buffer unit, according to the invention, which additionally contains a gas heating means associated with the barrel, and a gas heating control means installed on the barrel end.

It is preferable that the gas heating means in the gas detonation coating apparatus should have annular grooves made on the inner cylindrical surface of the barrel initial portion and/or on the inner surface of the barrel closed end.

It is also expedient that the gas heating means in the given gas detonation coating apparatus should additionally comprise heat-insulation tubes enclosing each of the additional pipes.

It is preferred that the gas heating means in the gas detonation coating apparatus in question should have annular grooves made on the inner surface of the main pipe.

It is reasonable that the barrel in the proposed gas detonation coating apparatus should additionally comprise a means to compensate for elongation of the barrel relative to the casing during gas heating, installed on the barrel end.

The present invention makes it possible to ensure detonation of the gases, omitting the stage of slow combustion thereof. In other words, it allows combustible gases to be economized and the capacity of the apparatus to be enhanced.

BRIEF DESCRIPTION OF DRAWINGS

Other objects and advantages of the invention will hereinafter become more fully apparent from the following description of a specific embodiment thereof with reference to the accompanying drawings, wherein.

DETAILED DESCRIPTION OF THE INVENTION

Figure 1:
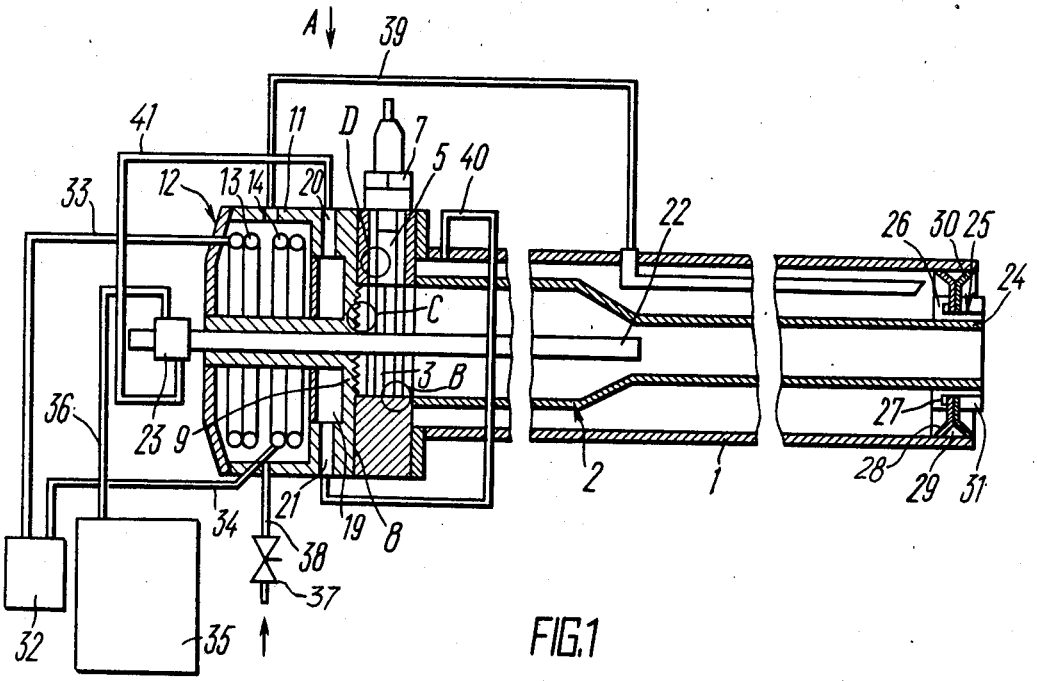
FIG. 1 illustrates a gas detonation coating apparatus (longitudinal section), according to the invention.

A gas detonation coating apparatus comprises a barrel 2 (FIG. 1) enclosed in a casing 1, with annular grooves 4 made on the inner surface of the barrel initial portion 3.

At the initial portion 3 of the barrel 2 (FIG. 1) there is inserted a main pipe 5 with annular grooves 6 (FIG. 5) made on the inner surface thereof. The pipe 5 (FIG. 1) houses a spark plug 7. An end 8 of the barrel 2 mounts a cover 9. Annular grooves 10 (FIG. 4) are made on the inner surface of the cover 9 (FIG. 1), namely, on the portion located on the hole in the end 8 of the barrel 2. The cover 9 mounts a casing 11 of a buffer unit 12. The latter includes spiral gas conduits 13 and 14 connected with the barrel 2 through additional pipes 15 and 16 (FIG. 2), which are enclosed in heat insulation tubes 17 and 18 respectively. The end wall of the casing 11 (FIG. 1) and the cover 9 form a gas heating control means 19. The cover 9 has channels 20, 21 for the liquid to flow through. A tube 22 of a powder sprayer 23 is inserted in the barrel 2 through the holes in the cover 9 and the end 8. The end of the barrel 2 (near its muzzle 24) carries a means 25 to compensate for elongation of the barrel 2 relative to the casing 1 during gas heating. The means 25 comprises a bushing 26, a gasket 27, a disk 28, a gasket 29, a disk 30 and a nut 31, all located on the barrel 2. The gas conduits 13 and 14 are connected with a gas supply means 32 through tubes 33 and 34 respectively. The sprayer 23 is connected with a liquid flow rate control means 35 through a tube 36. The apparatus contains a liquid, (e.g. water supply system incorporating a valve 37 and a tube 38 coupled with each other, the tube 38 being enclosed in the casing 11 of the unit 12; a tube 39 communicating the inner spaces of the casing 11 with the casing 1 of the barrel 2; a tube 40 communicating the inner space of the casing 1 of the barrel 2 with the channel 21; a tube 41 communicating the channel 20 with the sprayer 23; and the tube 36.

The apparatus operates as follows.

Prior to starting the apparatus, the valve 37 (FIG. 1) is opened, which makes water flow through the tubes 38, 39, 40, 41 and 36 and fill the spaces between the casing 1 and the barrel 2 and between the casing 11 of the buffer unit 12 and the cover 9, to be subsequently drained through the liquid flow rate control means 35.

Figure 2:
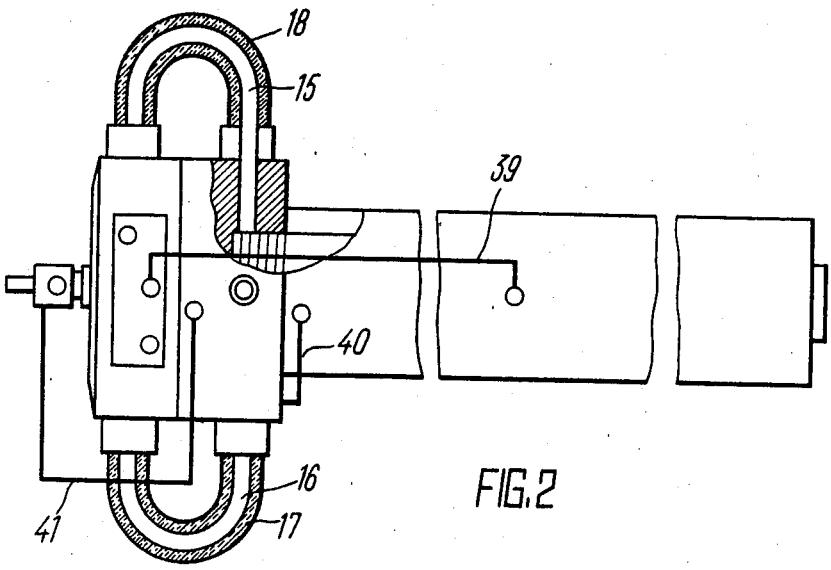
FIG. 2 is a view along the arrow A in FIG. 1 (with a broken-out section)
Figure 3:
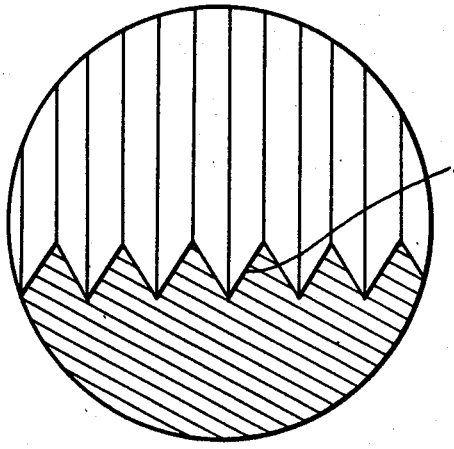
FIG. 3 shows the detail B of FIG. 1 (enlarged), according to the invention.
Figure 4:
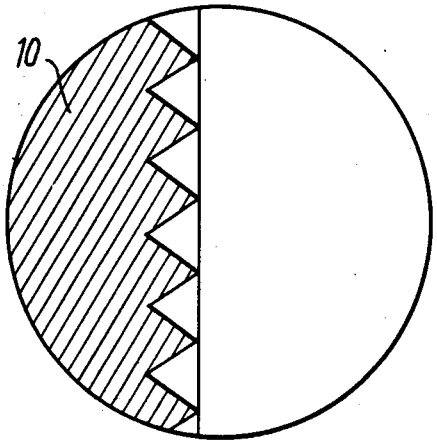
FIG. 4 shows the detail C of FIG. 1 (enlarged), according to the invention.
Figure 5:
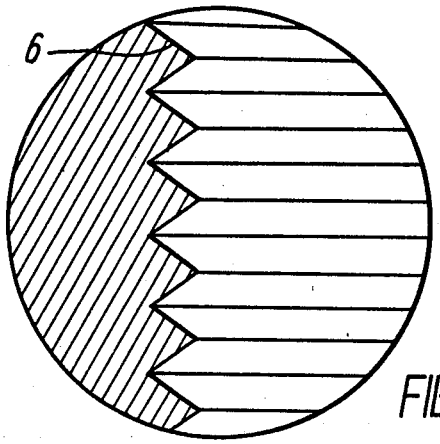
FIG. 5 represents the detail D of FIG. 1 (enlarged), according to the invention.

Thereupon the gas supply means 32 is turned on. The apparatus works in cycles, each cycle accompanied by gas flowing into the barrel 2 and the main pipe 5 through tubes 33 and 34, gas conduits 13 and 14, and additional pipes 15 and 16 (FIGS. 1 and 2). This is followed by switching on the ignition. After the gases have filled the barrel 2, the gas mixture, e.g. propane-butane and oxygen mixture, is ignited in each cycle with the aid of the spark plug 7. The detonation products quickly heat up the walls of the barrel 2 and the annular grooves 4, 6 and 10 (FIGS. 3, 4 and 5).

The gases flowing into the barrel 2 (FIGS. 1, 2) are heated up in two stages. During the first stage the gases are warmed up in the additional pipes 15 and 16 heated up in cycles by the detonation products. The heat insulation tubes 17 and 18 prevent the pipes 15 and 16 from cooling down.

The second stage is accompanied by the gases being heated up in the barrel 2 and partially in the main pipe 5. The annular grooves 4, 6 and 10 (FIGS. 3, 4 and 5) made respectively on the inner cylindrical surface of the initial portion 3 (FIG. 1) of the barrel 2, the inner surface of the main pipe 5 and on the inner surface of the cover 9 on the end 8 of the barrel 2, enhance the efficiency of heat exchange with the gases due to an increase in the heat exchange area and due to gas turbulization. The gases are heated to a temperature approximating that of self-ignition, which results in pyrolysis and the formation of cold flame zones. A mixture ignited after the formation of the cold flame zones considerably reduces the pre-detonation distance. Besides, the annular grooves 4, 10 and 6 (FIGS. 3, 4 and 5), along with intensifying the mixture heating process, are artificial obstacles turbulizing and accelerating the flame flow. Reflected from an obstacle, a warmed-up mixture containing cold flame zones instantaneously reaches a temperature sufficient for self-ignition of the mixture before the flame front. A plurality of ignition sites accelerating the burning process originate on the perimeter of the barrel 2 (FIGS. 1, 2, 3, 4 and 5) in the zone of the grooves 4, 10, 6. A combination of a preliminarily heated dissociated mixture with turbulization allows the pre-detonation portion to be drastically shortened, which is highly favourable for generating the detonation waves.

According to the invention, the maintenance of high temperatures on surfaces contacting the detonation products also precludes condensation of water vapours contained in the detonation products, thereby preventing the powder from sticking to the walls of the barrel 2 and from jamming the sprayer tube 22.

Having a temperature of 20° C. at the inlet of the valve 37, the water cools the gas conduits 13 and 14 reliably, protecting the gas supply system 32 against backflash. Passing through the gas heating control means 19, the heated water ensures a high temperature of the grooves 10 on the cover 9. The liquid flow control means 35 monitors the water temperature, and influences the temperature of the cover 9 and, consequently, the gases by varying the liquid flow rate.

Gas heating is concurrent with constant rise of temperature of the barrel 2. The temperature difference between the casing 1 and the barrel 2 results in the elongation of the barrel 2 relative to the casing 1.

According to the invention, the gasket 29 of the means 25 to compensate for elongation of the barrel 2 relative to the casing 1 is free to slide relative to the casing 1, thereby preventing the barrel 2 from destruction.

The present invention allows explosion hazard to be considerably reduced.

Furthermore, the present invention makes it possible to extend the production capabilities by using available cheap combustible gases which, when combined with relatively simple and cheap equipment, makes them readily available for various branches of the national economy both in manufacturing new machine parts and in reconditioning worn-out ones.

What is claimed is:

1. A gas detonation coating apparatus comprising:

a casing;

a barrel at least partially enclosed in the casing, having a through space formed by an inner surface, an initial portion and an end portion, a first, a second and a third hole in said initial portion;

a first pipe arranged in the initial portion having an inner surface and a first and a second end, with said first end in communication with the through space through said first hole in the initial portion of said barrel;

a second pipe having a first and a second end with said first end thereof in communication with the through space through said second hole of the initial portion of said barrel;

a spark plug arranged in communication with said first pipe;

a cover having an inner surface covering the third hole of the initial portion of the barrel and an outer surface, the cover having a hole for passage of a conduit for admitting a powder discharging end of a powder spraying means into the through space of the barrel;

a buffer unit, adjacent said outer surface of said cover, comprising:

a casing;

a first gas conduit arranged in the casing having an inlet and an outlet, with said outlet thereof gas-tightly associated with said second end of the first pipe;

a second gas conduit having an inlet and an outlet, with said outlet thereof gas-tightly associated with said second end of said second pipe;

the powder discharging end of a powder spraying means being inserted into said barrel through a hole in said casing of said buffer unit and the hole in said cover;

a gas heating means integrally associated with the initial portion of the barrel and the cover;

a gas heating control means to control the temperature of the gas in the initial portion of the barrel; and a gas supply means having a first and a second outlet, said first and second outlets gas-tightly communicating with the inlets of the first and second gas conduits.

2. An apparatus as claimed in claim 1, wherein said gas heating means includes:

a plurality of annular grooves formed on said inner surface of said initial portion of said barrel.

3. An apparatus as claimed in claim 1, wherein said gas heating means includes:

a plurality of annular grooves formed on said inner surface of said cover.

4. An apparatus as claimed in claim 1, wherein said gas heating means includes:

a first plurality of annular grooves formed on said inner surface of said initial portion of said barrel;

a second plurality of annular grooves formed on said inner surface of said cover.

5. An apparatus as claimed in claim 1, wherein said barrel includes:

a means to compensate for elongation of said barrel relative to said casing during gas heating, installed on said end portion of said barrel.

6. An apparatus as claimed in claim 1, wherein the gas heating means includes:

a plurality of annular grooves formed on said inner surface of said first pipe.

7. An apparatus as claimed in claim 2, wherein said gas heating means includes:

a first heat insulated tube enclosing said first pipe; and a second heat insulated tube enclosing said second pipe.

8. An apparatus as claimed in claim 3, wherein said gas heating means includes:

a first heat insulated tube enclosing said first pipe; and a second heat insulated tube enclosing said second pipe.

9. An apparatus as claimed in claim 4, wherein said gas heating means includes:

a first heat insulating tube enclosing said first pipe; and a second heat insulated tube enclosing said second pipe.

10. An apparatus as claimed in claim 7, wherein the gas heating means includes:

a third plurality of annular grooves formed on said inner surface of said first pipe.

11. An apparatus as claimed in claim 8, wherein the gas heating means includes:

a plurality of annular grooves formed on said inner surface of said first pipe.

12. An apparatus as claimed in claim 9, wherein the gas heating means includes:

a third plurality of annular grooves formed on said inner surface of said first pipe.

* * * * *